US011541673B2

(12) United States Patent
Hoover et al.

(10) Patent No.: US 11,541,673 B2
(45) Date of Patent: Jan. 3, 2023

(54) SYSTEM AND METHOD FOR REMOVING INK SOLVENT AND WATER VAPORS IN AQUEOUS INK PRINTERS

(71) Applicant: Xerox Corporation, Norwalk, CT (US)

(72) Inventors: Linn C. Hoover, Webster, NY (US); John Baker, Webster, NY (US); David S. Derleth, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 220 days.

(21) Appl. No.: 17/014,479

(22) Filed: Sep. 8, 2020

(65) Prior Publication Data

US 2022/0072873 A1 Mar. 10, 2022

(51) Int. Cl.

| | |
|---|---|
| ***B41J 11/00*** | (2006.01) |
| ***B41J 11/58*** | (2006.01) |
| ***B41J 2/045*** | (2006.01) |

(52) U.S. Cl.

CPC ..... *B41J 11/002* (2013.01); *B41J 2/04586* (2013.01); *B41J 11/0045* (2013.01); *B41J 11/58* (2013.01)

(58) Field of Classification Search

CPC ... B41J 11/002; B41J 11/0022; B41J 11/0045; B41J 11/58; B41J 2/1714; B41J 2/16585; B41J 2/2146; B41J 2/155; B41J 2/01

See application file for complete search history.

(56) References Cited

U.S. PATENT DOCUMENTS

| | | | | |
|---|---|---|---|---|
| 9,403,383 | B1 * | 8/2016 | Liu | B41J 11/00214 |
| 10,328,703 | B2 * | 6/2019 | Tanaka | B41J 2/175 |
| 2005/0036023 | A1 * | 2/2005 | Costanza | B41J 13/103 347/104 |
| 2005/0046679 | A1 * | 3/2005 | Sanada | B41J 2/155 347/68 |
| 2014/0176640 | A1 | 6/2014 | Hawryschuk et al. | |
| 2014/0176641 | A1 | 6/2014 | Hawryschuk et al. | |
| 2014/0176654 | A1 | 6/2014 | Hawryschuk et al. | |
| 2015/0115517 | A1 * | 4/2015 | Asada | B41J 11/485 271/9.11 |
| 2015/0343796 | A1 * | 12/2015 | Ohnishi | B41J 11/00214 347/102 |

* cited by examiner

*Primary Examiner* — John Zimmermann

(74) *Attorney, Agent, or Firm* — Maginot Moore & Beck LLP

(57) ABSTRACT

An aqueous ink printer is operated to insert media sheets from a first supply tray into a plurality of media sheets from a second tray on which ink images are being formed by the printer to absorb condensed vapors on media guides. The media sheets from the first tray are uncoated media and the media sheets from the second tray are coated media. In some embodiments, the inserted media sheets are printed with an ink image that has areas that contact the media guides with a greater ink density than other areas of the ink image that do not contact the media guides. Additionally or alternatively, the inserted media sheets are printed with an ink image that has areas that contact the media guides with an ink color that is different than an ink color used in other areas of the ink image that do not contact the media guides.

19 Claims, 6 Drawing Sheets

SYSTEM AND METHOD FOR REMOVING INK SOLVENT AND WATER VAPORS IN AQUEOUS INK PRINTERS

TECHNICAL FIELD

This disclosure relates generally to aqueous ink printing systems, and more particularly, to the removal of ink solvent and water vapors from such printers.

BACKGROUND

Known aqueous ink printing systems print images on uncoated and coated substrates. Whether an image is printed directly onto a substrate or transferred from a blanket configured about an intermediate transfer member, once the image is on the substrate, the water and other solvents in the ink must be substantially removed to fix the image to the substrate. A dryer is typically positioned after the transfer of the image from the blanket or after the image has been printed on the substrate for removal of the water and solvents from the ejected ink. To enable relatively high speed operation of the printer, the dryer heats the substrate and ink to temperatures that typically reach 100° C. Uncoated substrates generally require exposure to the high temperatures generated by the dryer for a relatively brief period of time, such as about 500 to 750 msec, for effective removal of the liquids from the surfaces of the substrates.

Coated substrates are typically used for high quality image brochures and magazine covers. Printing images with high area ink coverage on coated media releases significant amounts of water and cosolvent vapors inside the dryer module. Air flow through the dryer module carries this vapor downstream through the simplex and duplex media paths. Water and cosolvents not evaporated within the dryer module continue to vaporize from the hot media exiting the dryer so they continue to release vapors inside the downstream media path. This vapor on the printed media guides gradually accumulates to a level that condenses into droplets on the guides. These droplets grow in size until a sheet of media contacts the droplets or the droplets drip from the guide onto the sheet passing under the guide. These condensed vapor drops can produce IQ defects in the image on the printed substrate. Developing systems and methods that more effectively remove ink solvent and water vapors from an aqueous ink printer, particularly when coated media are being printed, would be beneficial.

SUMMARY

A new aqueous ink printing system includes a system that more effectively removes ink solvent and water vapors from the output printed media paths in the printer. The printing system includes a first media supply tray, a second media supply tray, at least one printhead configured to eject drops of an aqueous ink onto substrates moving past the at least one printhead to form aqueous ink images on the substrates, a dryer positioned to receive the substrates after the substrates have received the drops of aqueous ink from the at least one printhead, the dryer being configured to heat the substrates and evaporate liquids from the aqueous ink images on the substrates, at least one media guide positioned to guide the substrates past the printheads and through the dryer, a substrate transport for moving substrates past the at least one printhead and through the dryer, a plurality of actuators, and a controller operatively connected to the at least one printhead, the substrate transport, and the plurality of actuators. The controller is configured to operate a first actuator to move a plurality of media sheets from the first media supply tray to the substrate transport, to operate a second actuator to move a plurality of media sheets from the second media supply tray to the substrate transport, to operate the substrate transport to move substrates received from the first media supply tray and the second media supply tray past the at least one printhead and through the dryer, to operate the at least one printhead to print ink images on media sheets received from the second media supply tray, to operate the first actuator to insert one or more media sheets from the first media supply into the plurality of substrates moved from the second media supply tray to the substrate transport, the inserted one or media sheets being configured to absorb condensed vapors from the at least one media guide as the inserted one or more media sheets are moved by the substrate transport past the printheads and through the dryer.

A method of operating an aqueous ink printing system more effectively removes ink solvent and water vapors from the output printed media paths in the printer. The method includes operating with a controller a first actuator to move a plurality of media sheets from a first media supply tray to a substrate transport, operating with the controller a second actuator to move a plurality of media sheets from a second media supply tray to the substrate transport, operating with the controller the substrate transport to move substrates received from the first media supply tray and the second media supply tray past at least one printhead and through a dryer, operating with the controller the at least one printhead to print ink images on media sheets received from the second media supply tray to form cockle in the media sheets received from the second media supply tray, to operate the first actuator to insert one or more media sheets from the first media supply into the plurality of substrates moved from the second media supply tray to the substrate transport so the inserted one or media sheets in which the cockle was formed absorb condensed vapors from the at least one media guide as the inserted one or more media sheets are moved by the substrate transport past the printheads and through the dryer.

BRIEF DESCRIPTION OF THE DRAWINGS

The foregoing aspects and other features of an aqueous ink printing system and its method of operation that more effectively removes ink solvent and water vapors from the output printed media paths in the printer are explained in the following description, taken in connection with the accompanying drawings.

DETAILED DESCRIPTION

Figure 1:
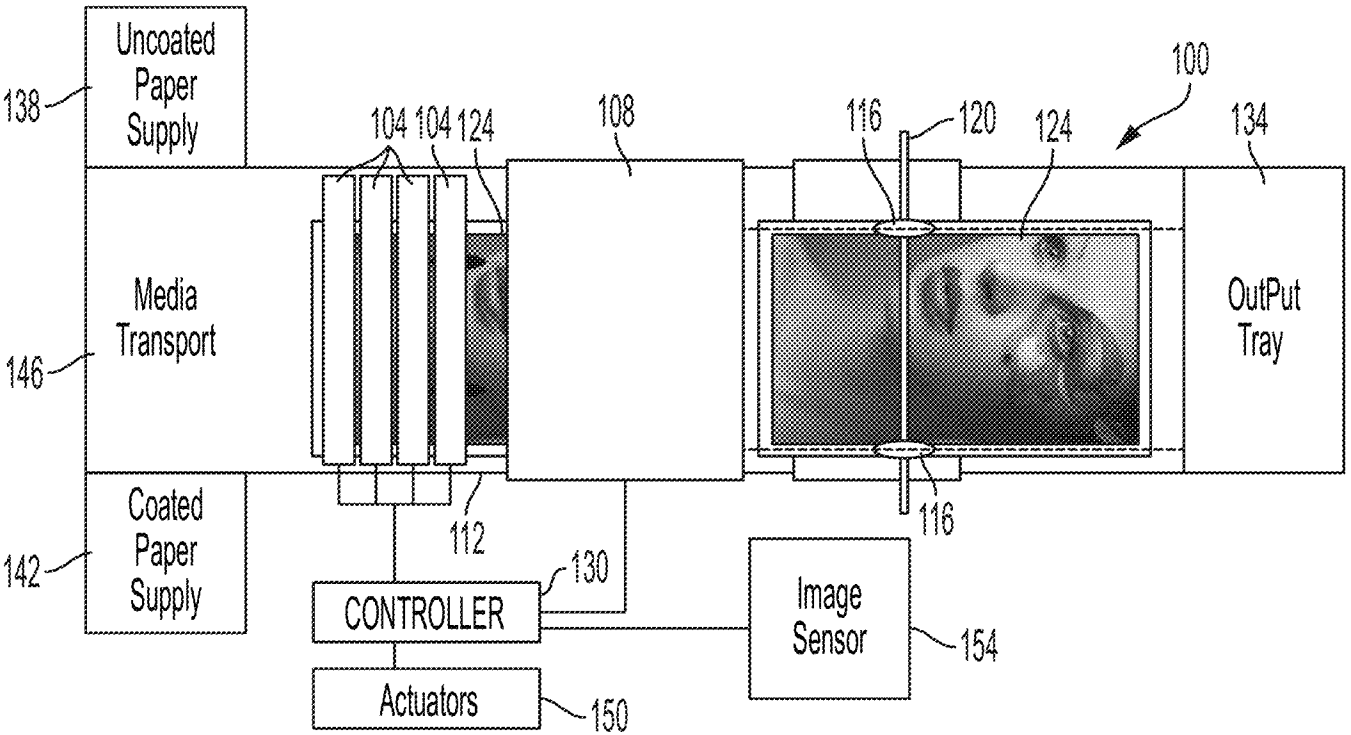
FIG. 1 is a schematic diagram of an aqueous ink printing system that more effectively removes ink solvent and water vapors from the output printed media paths in the printer.

For a general understanding of the present embodiments, reference is made to the drawings. In the drawings, like reference numerals have been used throughout to designate like elements.

FIG. 1 depicts a schematic diagram of an aqueous printing system 100 that is configured to print aqueous ink images on coated media and effectively remove the water and ink solvent vapors produced by the dryer and so attenuate adverse effects on the image quality of the printed images. The system 100 includes one or more arrays 104 of printheads, a dryer 108, a transport belt 112, a pair of nip rollers 116 mounted about a member 120 that extends in a cross-process direction across the substrates 124 carried by the transport belt 112, a controller 130, an output tray 134, a media supply tray 138, a media supply tray 142, a media transport 146, a plurality of actuators 150, and an image sensor 154. As used in this document, the term "dryer" refers to a configuration of heat producing elements that can be variably operated to dry a printed substrate as the substrate passes by the heating elements. The words "dry" and "drying" as used in this document means using a form of energy to evaporate a liquid or a solvent in an ink image on a substrate. The transport belt 112 is an endless belt wrapped about two or more rollers, one of which is driven by the controller 130 operating one of the actuators 150 to rotate the belt about the rollers. As used in this document, the term "cross-process direction" refers to the direction perpendicular to the direction of substrate movement past the printheads and through the dryer that also lies in the plane of the substrate. The term "process direction" as used in this document refers to the direction of substrate movement past the printheads and through the dryer that also lies in the plane of the substrate.

The printhead arrays 104 are operated by the controller 130 in a known manner to eject drops of aqueous ink onto the substrates passing by them to form ink images on the substrates. The dryer 108 is configured with a plurality of heating elements that typically arranged in an array. The printed substrates exit from being opposite the printhead arrays 104 and enter the dryer 108 for evaporation of water and ink solvents from the printed ink image. An image data source (not shown) provides the color separation data to the controller for an ink image to be printed and these data are used by the controller 130 to generate the firing signals to operate the inkjets in the printheads of the printhead arrays 104 to eject ink for each pixel in a color separation. Although a single controller 130 is shown in FIG. 1 for operating the dryer 108 and the printhead arrays 104, and the actuators 150, two or more controllers or other logic units, processors, or the like, can be used to operate the dryer, the printhead arrays, and the actuators separately with the different controllers communicating with one another to synchronize the operations described below.

Figure 2:
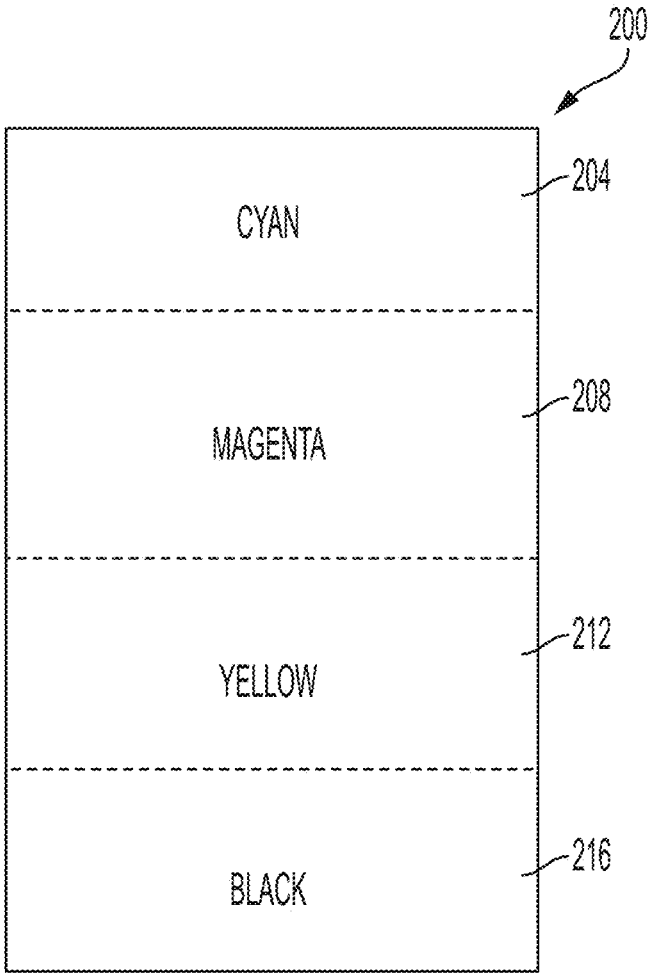
FIG. 2 is a depiction of a 100% ink density test pattern to activate all of the inkjets in the printhead arrays of FIG. 1.

When the printer 100 of FIG. 1 is activated for a print job, the controller operates an actuator 150 to move an uncoated media sheet from the media supply tray 138 to the media transport 146 to move the uncoated media sheet in a process direction through the printer 100. This uncoated media sheet is printed with a stripe of each color of ink used in the printer. For example in FIG. 2, four stripes are printed on the sheet 200 with a stripe 204 of cyan ink printed by one of the printhead arrays 104, a stripe 208 of magenta ink printed by another one of the printhead arrays 104, a strip 212 of yellow ink printed by another one of the printhead arrays 104, and a strip 216 of black ink printed by the remaining printhead array 104. Printing this pattern on the sheet 200 fires all of the printhead nozzles prior to the start of a print job so the stripes 204, 208, 212, and 216 are areas of 100% ink density for the respective colors. This action ejects ink from each inkjet in the printhead arrays 104 and helps clear ink from the inkjets that may be drying depending upon the time that has passed from the last print job. The sheet 200 then moves through the dryer 108 so water and ink solvents can be evaporated from the printed ink. Because the sheet 200 has four areas of 100% ink density, the amount of evaporated water and ink solvents is substantial. Thus, this warmup operation, while useful for commencing operation of the printer, also produces vapors that may impact the quality of later printed images. After the sheet 200 passes through the dryer 108, the transport belt 112 continues to carry the sheet 200 through the printer 100 and media guides, such as the rollers 116, to the output tray 134. These media guides and the actuators 150 operatively connected to them are operated by the controller 130 to direct media sheets through simplex and duplex paths in the printer 100 for additional processing or positioning for additional printing as required in a print job until they are discharged into the output tray 134. The vapors released by the dryer 108 from the first test image printed on the sheet 200 begin to accumulate on the media guides in the printer 100.

Figure 3:
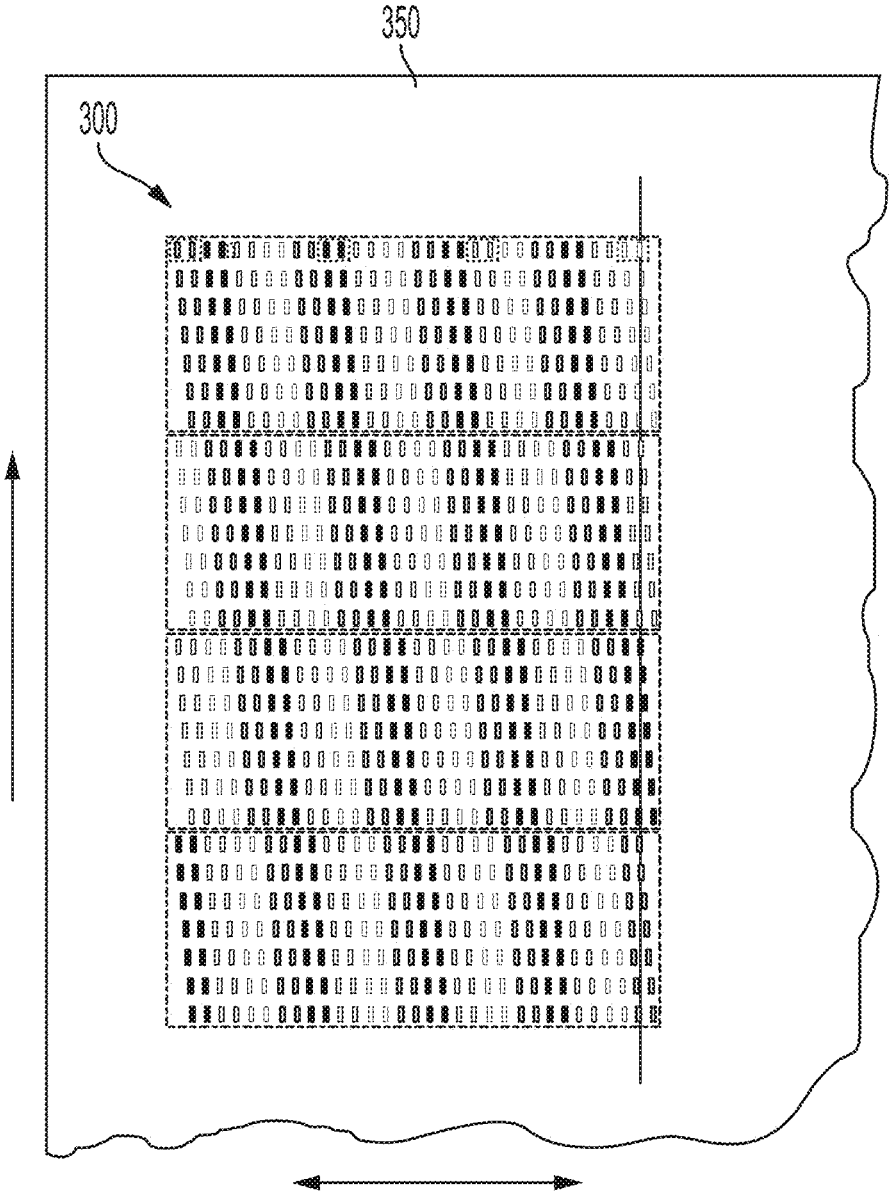
FIG. 3 is an exemplary test pattern printed to detect inoperative and weak inkjets in the printhead arrays of FIG. 1.

As the sheet 200 passes through the printer 100, the controller 130 operates one of the actuators 150 to move another sheet of uncoated media sheet from the supply tray 138 onto the media transport 112 for the printing of another test pattern on the sheet. FIG. 3 shows an exemplary inoperative inkjet test pattern 300 that can be printed on another uncoated media sheet 350 after the sheet 200 has been printed with the test pattern of FIG. 2. Again, the controller 130 retrieves data corresponding to the test pattern 300 and operates the inkjets in the printhead arrays 104 to form the test pattern 300 on the sheet 350. After the test pattern 300 has been printed on the sheet 350, the image sensor 154 generates image data of the printed test pattern 300 on the sheet 350 so the controller 130 can analyze the printed test pattern and detect inoperative or weak inkjets. After detection of these inoperative and weak inkjets, the controller 130 applies known inkjet correction algorithms prior to starting the print job that compensate for the inoperative and weak inkjets so streaks in the printed images are minimized. The controller 130 then commences the print job by operating the actuators 150 to feed coated media sheets from the media supply tray 142 to the media transport 112 for movement of the sheets through the printer 100, operate the inkjets in the printhead arrays 104 to form images on the coated media sheets that correspond to the image data the controller receives from the image source for the print job, operate the dryer 108 to evaporate the water and solvents from the printed images, and operate the actuators 150 to direct the sheets through the printer for additional processing or positioning for additional printing.

In previously known aqueous printing systems, the controller 130 operates an actuator 150 to insert an uncoated media sheet from the media supply tray 138 into the sheets being printed in the print job so the uncoated sheet can be printed with the test pattern 300 at predetermined intervals and then the controller 130 analyzes the image data of the printed test pattern 300 generated by the image sensor 154 to determine whether additional inkjets have become inoperative or weak. The controller then applies appropriate algorithms to compensate for the inoperative or weak inkjets throughout the remainder of the print job. As used in this document, the word "insert" or "inserted" means that a series of media sheets being supplied from one media supply tray to the substrate transport for the production of ink images on the media sheets is interrupted by one or more media sheets from another media supply tray.

During empirical testing conducted to quantify the rate of vapor condensation versus the ink density of various printed images, some ink densities were noted as leading to moisture streaks appearing on the initial test pattern sheets 200 and on the media sheets inserted in the print job for the purpose of detecting inoperative and weak inkjets. Since the sheets 200 are printed at a 100% ink density, they consistently had wet streaks that began at the leading edge of the sheet and continued along the sheet in the process direction. These wet streaks were larger than the wet streaks that occurred on the sheets that were inserted for test pattern printing, which typically only had wet streaks that began about 8-10 mm from the leading edge.

To remove the amount of water and solvent vapor accumulating in the printing system that caused these streaks, several additional non-coated media sheets from supply tray 138 are inserted into the print job to absorb the vapor accumulating on the media guides in the media output path. To improve the amount of contact of the uncoated media sheets with the media guides for purposes of improved absorption, the inserted non-coated media sheets are printed with high ink density coverage images. Because the media fibers of the uncoated media sheets absorb water and solvents from the ink forming the image on the media well, they relax and swell until they are dried in the dryer. As the moisture evaporates from the fibers, the swollen fibers shrink and buckle. This phenomenon is known as cockle and as used in this document, the term "cockle" means wrinkles produced in media by the absorption of solvents, including water, from ink on the media. Printing techniques have been developed to reduce or eliminate cockle in printed uncoated media to prevent poor image quality. The system disclosed in this document; however, forms ink images on uncoated media to produce cockle can vary the height of the media of in predetermined areas or edges of about 1 mm to about 3 mm. This resulting cockle increases the amount of uncoated media contact with the media guides. Thus, by printing portions of the uncoated media that pass by the media guides in the printer with variable high ink density coverage areas, those portions of the media develop substantial cockle and contact the paper guides more so they can absorb more of the vapors condensing on the media guides. In fact, media edge curl can be varied by changing the density of the high density coverage stripes formed along the edges of the sheet. Full media sheet curl and cockle can be generated by printing high density coverage areas, such as wide stripes, checker board patterns, and the like across the entire sheet. Ink color also impacts media curl and cockle because some ink pigments couple better with the infrared (IR) lamps used in some dryers. For example, black ink absorbs more IR energy and reaches higher temperatures that yellow ink. The resulting non-uniform temperature distribution across the sheet arising from the different ink colors causes more cockle in the higher temperature areas. Therefore, inserting several non-coated media sheets at predetermined intervals in a print job and printing images on them with specific combinations of high density coverage images and different colors can effectively clean the condensed vapor from the media guides in the simplex and duplex media paths in the printer and attenuate related image quality defects on coated media. The predetermined intervals for inserting uncoated media can be determined by a number of coated media sheets that have been printed, a predetermined time interval between insertions of uncoated media sheets, or a predetermined amount of aqueous ink that has been ejected from the printhead arrays since the immediately preceding insertion of uncoated media sheets.

The surface coatings typically applied to coated media, on the other hand, do not absorb fluids well and spread the condensed vapor that falls from the paper guides onto the ink images printed on the coated media sheets. The condensed vapor adversely impacts the quality of the images. For a given media weight, coated media has fewer media fibers per square meter than non-coated media because the coating, such as clay, can account for 30-40% of the weight. The coating also slows or prevents the fluid from absorbing into the media fibers; therefore, coated media typically cockles less than non-coated media because coated media has less media fiber per square meter. Consequently, the use of coated media sheets for the absorption of the condensed vapors on the media guides is not as efficient as is the use of uncoated media sheets, especially those printed with targeted high density coverage areas.

Figure 4:
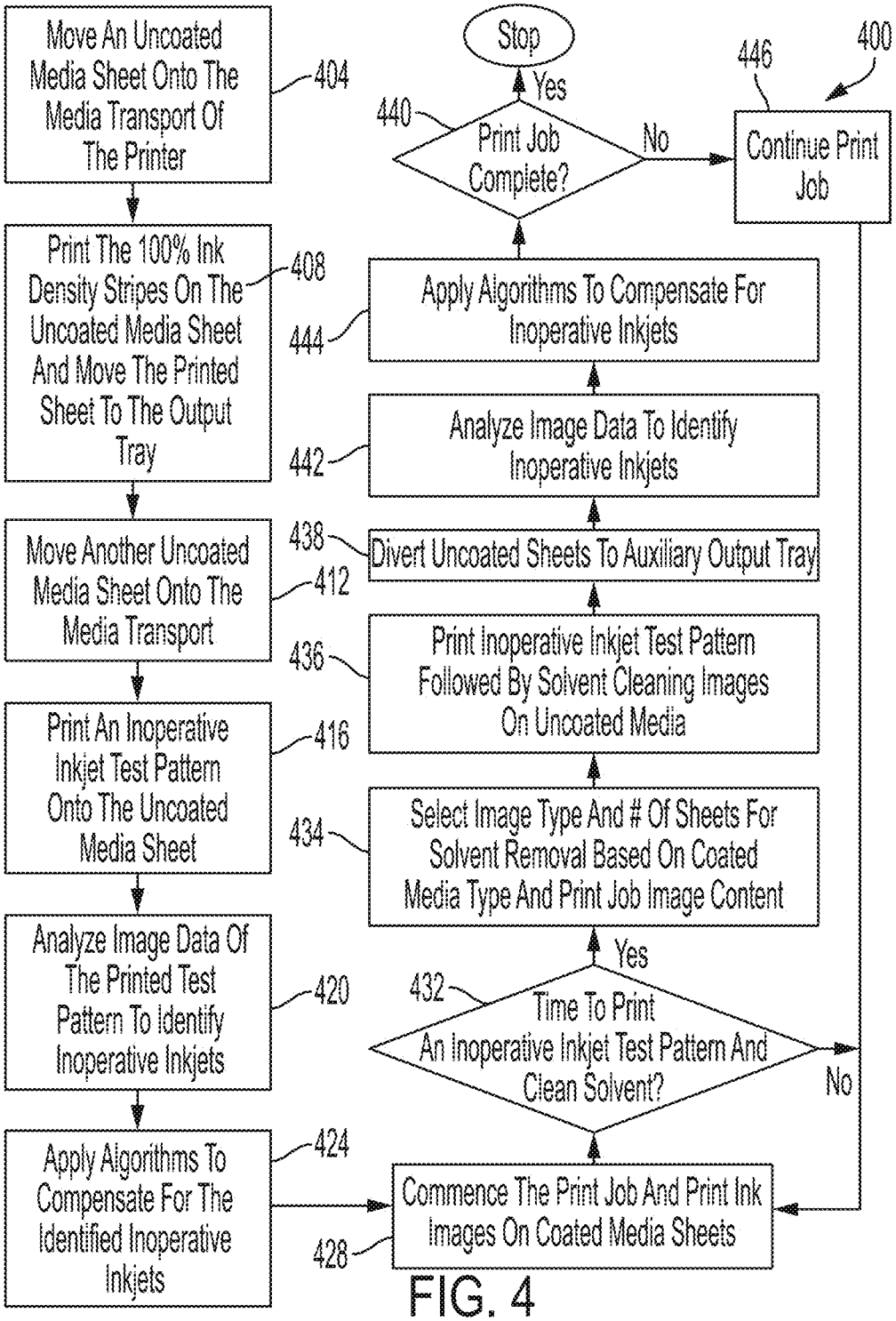
FIG. 4 is a flow diagram of a process for operating the printer of FIG. 1 to print aqueous ink images on coated media and effectively remove the water and ink solvent vapors produced by the dryer.

A process 400 for operating the printer 100 to remove condensed vapors from media guides during a print job is shown in FIG. 4. In the description of the process, statements that the process is performing some task or function refers to a controller or general purpose processor executing programmed instructions stored in non-transitory computer readable storage media operatively connected to the controller or processor to manipulate data or to operate one or more components in the printer to perform the task or function. The controller 130 noted above can be such a controller or processor. Alternatively, the controller can be implemented with more than one processor and associated circuitry and components, each of which is configured to form one or more tasks or functions described herein. Additionally, the elements of the method may be performed in any feasible chronological order, regardless of the order shown in the figures or the order in which the processing is described.

The process 400 begins with an uncoated media sheet being moved from the media supply tray containing uncoated media sheets onto the media transport (block 404). The 100% ink density stripes of each color are printed on the sheet and the sheet is moved through the printer to the output tray (block 408). Another uncoated media sheet is moved from the media supply tray containing the uncoated media sheets onto the media transport (block 412) and printed with an inoperative inkjet test pattern (block 416). The image data of the printed test pattern image is analyzed to identify inoperative and weak inkjets (block 420) and appropriate algorithms are applied to compensate for the identified inoperative and weak inkjets (block 424). The print job is commenced with coated media sheets being retrieved from the media supply containing coated media sheets and printed with ink images corresponding to the image data received from an image data source for the print job (block 428). The print job continues until a predetermined interval passes (block 432), at which time, an inoperative inkjet test pattern and cockled uncoated media are inserted into the print job. The process uses the coated media type and the print job image content since either the start of the print job or since the last insertion of cockled uncoated media sheets and determines the type of image to be printed on the uncoated media sheets and the number of cockled uncoated media sheets to insert into the print job to absorb condensed solvent vapors on the paper guides (block 434). The determined number of uncoated media sheets are printed with the selected image and inserted into the print job followed by an uncoated media sheet printed with an inoperative inkjet test pattern (block 436). The inserted uncoated media sheets are diverted to an auxiliary output tray so they are not mixed with the print job output (block 438). As the inoperative inkjet test pattern passed the image sensor 154, image data of the pattern was generated and this data is analyzed to identify inoperative inkjets in the same manner test pattern image data was analyzed during the processing that occurred in block 420 (block 442). The algorithms used to compensate for inoperative inkjets are applied in the same manner as occurred during the processing of block 424 (block 444). If the print job is finished (block 440), the process stops. Otherwise, the print job continues (blocks 446 and 428) until another predetermined interval passes (block 432).

The type of image printed on an uncoated media sheet noted above with regard to the processing of block 434 refers to an image that produces an amount of cockle adequate to contact the print guides at the appropriate locations. Producing cockle in uncoated sheets that matches the printer architecture requires empirical experimentation with specific ink densities, image placement, and dryer temperatures with various uncoated plain media. Those images that generate cockle and curl that contact specific baffles and baffle interfaces in a particular type of printer are stored in a memory operatively connected to the controller of a printer in association with a corresponding uncoated media type. During the processing of block 434, the controller retrieves the image type stored in association with the type of uncoated media sheets being used for the remedial action. For example, a duplex printed image, that is, an image printed on both sides of a sheet induces more cockle that the printing of the same image on a single side of the sheet, known as a simplex image. Additionally, printing an image on one side as opposed to two sides can affect the direction of the curl, either up or down, so the leading edge or trailing edge of a sheet hits specific interfaces. Because the effectiveness of the remedial action depends upon the architecture of the printer, changes in a printer that occur over time, such as the addition of dryer modules, installation of different paper path elements, and the like, require additional empirical evaluations to determine the images associated with the different uncoated media sheets that can be used in a printer.

Figures 5A, 5B, 5C:
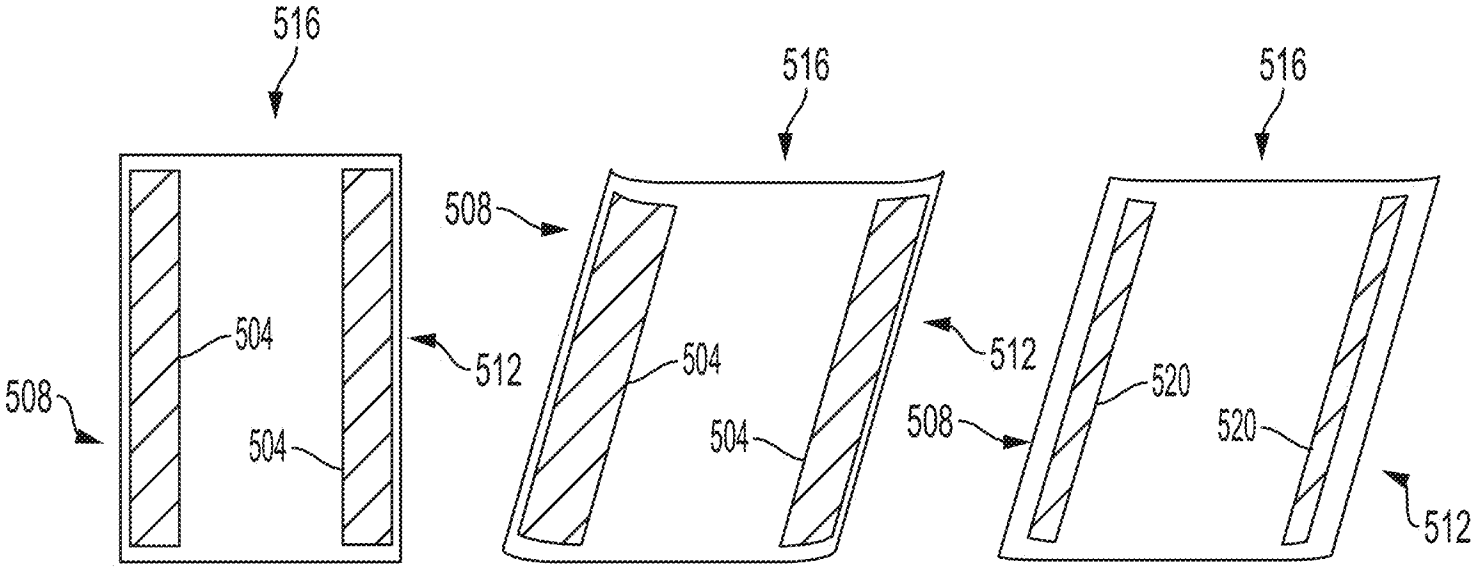
FIG. 5A is an example of an printed pattern used to produce curl in media sheets and FIG. 5B and FIG. 5C illustrate the effect of printed pattern position and size on the amount of curl.
Figure 6:
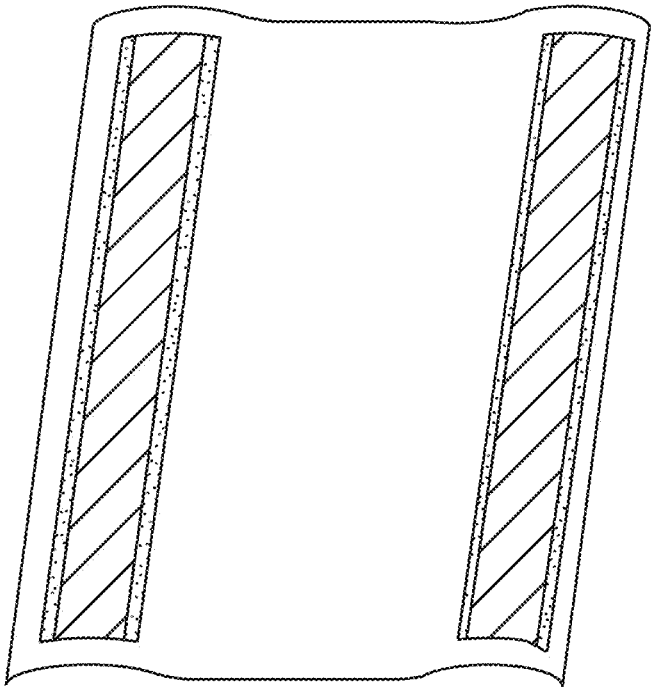
FIG. 6 illustrates the effect of simplex versus duplex printing of the printed pattern of FIG. 5A on the direction of paper curl.

The size, location, and ink density of printed areas on uncoated media sheets affects the amount of curl in the paper cockle and the degree of contact between the cockled areas and the paper guides and baffles of a printer. For example, relatively wide printed areas 504 at an ink density of 50% or more located within 1-2 mm of the trailing edge 508 and the leading edge 512 on one side of an uncoated media sheet 516 as shown in FIG. 5A produces more up-curl cockle at the leading and trailing edges as shown in FIG. 5B than relatively narrow printed areas 520 of the same density located within 4-6 mm of the trailing edge 508 and leading edge 512 as shown in FIG. 5C. Similarly, duplex printing of the image of FIG. 5A on an uncoated media sheet produces a downward curl in the sheet as shown in FIG. 6. Thus, the width, ink density, and position of the printed areas with respect to the leading and trailing edges of the media sheets affects the amount of paper curl and degree of media contact and simplex versus duplex printing of the areas affects the direction of the curl.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An aqueous ink printer comprising:

a first media supply tray;

a second media supply tray;

at least one printhead configured to eject drops of an aqueous ink onto substrates moving past the at least one printhead to form aqueous ink images on the substrates;

a dryer positioned to receive the substrates after the substrates have received the drops of aqueous ink from the at least one printhead, the dryer being configured to heat the substrates and evaporate liquids from the aqueous ink images on the substrates;

at least one media guide positioned to guide the substrates past the printheads and through the dryer;

a substrate transport for moving substrates past the at least one printhead and through the dryer;

a plurality of actuators; and a controller operatively connected to the at least one printhead, the substrate transport, and the plurality of actuators, the controller being configured to operate a first actuator to move a plurality of media sheets from the first media supply tray to the substrate transport, to operate a second actuator to move a plurality of media sheets from the second media supply tray to the substrate transport, to operate the substrate transport to move substrates received from the first media supply tray and the second media supply tray past the at least one printhead and through the dryer, to operate the at least one printhead to print ink images on media sheets received from the second media supply tray, to operate the first actuator to insert one or more media sheets from the first media supply into the plurality of substrates moved from the second media supply tray to the substrate transport, the inserted one or more media sheets being configured to absorb condensed vapors from the at least one media guide as the inserted one or more media sheets are moved by the substrate transport past the printheads and through the dryer, and to operate the at least one printhead to form at least one ink image on the one or more of the media sheets from the first media supply tray inserted into the plurality of substrates moved from the second media supply to form a cockle in the one or more of the media sheets from the first media supply tray to absorb condensed vapors from the at least one media guide.

2. The aqueous ink printer of claim 1, the controller being further configured to:

form the at least one ink image on the one or more media sheets from the first media supply tray so areas that contact the at least one media guide have an ink density that is greater than an ink density of areas that do not contact the at least one media guide.

3. The aqueous ink printer of claim 2, the controller being further configured to:

form the at least one ink image on the one or more media sheets from the first media supply tray so the areas that contact the at least one media guide have a first color of ink density that is different than a second color of ink ejected onto the areas that do not contact the at least one media guide.

4. The aqueous ink printer of claim 3 wherein the first color of ink is black and the second color of ink is one of yellow, cyan, and magenta.

5. The aqueous ink printer of claim 3, the controller being further configured to:

operate the at least one printhead to print a 100% ink density test pattern on at least one media sheet received from the first media supply tray prior to inserting the one or more media sheets received from the first media supply tray into the plurality of media sheets received from the second media supply tray; and operate the at least one printhead to print an inoperative inkjet test pattern on at least one other media sheet received from the first media supply tray prior to inserting the one or more media sheets received from the first media supply tray into the plurality of media sheets received from the second media supply tray and after the 100% ink density pattern has been formed on the at least one media sheet.

6. The aqueous ink printer of claim 2, the controller being further configured to:

select the at least one ink image using a type of media being inserted from the first media supply tray.

7. The aqueous ink printer of claim 6 wherein the selected at least one ink image induces cockle in one of the inserted media sheets at a leading edge.

8. The aqueous ink printer of claim 6 wherein the selected at least one ink image induces cockle in one of the inserted media sheets at a trailing edge.

9. The aqueous ink printer of claim 6 wherein the selected at least one ink image is a duplex image.

10. The aqueous ink printer of claim 6 wherein the selected at least one ink image is a simplex image.

11. The aqueous ink printer of claim 6, the controller being further configured to:

insert the one or more media sheets into the plurality of substrates from the second media supply tray at a predetermined interval.

12. The aqueous ink printer of claim 11 wherein the predetermined interval corresponds to a predetermined number of media sheets on which ink images have been formed by the at last one printhead.

13. The aqueous ink printer of claim 11 wherein the predetermined interval corresponds to a predetermined time period.

14. The aqueous ink printer of claim 11 wherein the predetermined interval corresponds to a predetermined amount of ink that has been ejected by the at least one printhead since an immediately preceding insertion of media sheets from the first media supply tray.

15. The aqueous ink printer of claim 11, the controller being further configured to:

operate a third actuator in the plurality of actuators to direct the media sheets from the first media supply into a first output tray; and operate a fourth actuator in the plurality of actuators to direct the media sheets from the second media supply in a second output tray that is different than the first output tray.

16. A method of operating an aqueous ink printer comprising:

operating with a controller a first actuator to move a plurality of media sheets from a first media supply tray to a substrate transport;

operating with the controller a second actuator to move a plurality of media sheets from a second media supply tray to the substrate transport;

operating with the controller the substrate transport to move substrates received from the first media supply tray and the second media supply tray past at least one printhead and through a dryer;

operating with the controller the at least one printhead to print ink images on media sheets received from the second media supply tray to form a cockle in the media sheets received from the second media supply tray, to operate the first actuator to insert one or more media sheets from the first media supply into the plurality of substrates moved from the second media supply tray to the substrate transport so the inserted one or more media sheets in which the cockle was formed to absorb condensed vapors from the at least one media guide as the inserted one or more media sheets are moved by the substrate transport past the printheads and through the dryer.

17. The method of claim 16 further comprising:

operating the at least one printhead to form at least one ink image on the one or more of the media sheets from the first media supply tray to form the cockle in the one or more of the media sheets from the first media supply tray to absorb condensed vapors from the at least one media guide.

18. The aqueous ink printer of claim 17 further comprising:

forming the at least one ink image on the one or more media sheets from the first media supply tray so areas that contact the at least one media guide have an ink density that is greater than an ink density of areas that do not contact the at least one media guide.

19. The method of claim 18 further comprising:

forming the at least one ink image on the one or more media sheets from the first media supply tray so the areas that contact the at least one media guide have a first color of ink density that is different than a second color of ink ejected onto the areas that do not contact the at least one media guide.

* * * * *